United States Patent [19]

Ostrum et al.

[11] Patent Number: 4,790,448

[45] Date of Patent: Dec. 13, 1988

[54] CONTAINER AND LID WITH TAMPER EVIDENT CLOSURE

[75] Inventors: James V. Ostrum, St. Paul; Gary C. Springer, Maple Grove; Kenneth G. Weller, Minneapolis; Richard: John E., Rockford; Robert E. Montrose, Plymouth, all of Minn.

[73] Assignee: Liberty Diversified Industries, New Hope, Minn.

[21] Appl. No.: 93,980

[22] Filed: Sep. 8, 1987

[51] Int. Cl.[4] ..... B65D 17/34

[52] U.S. Cl. ..... 220/270; 220/276; 215/256

[58] Field of Search ..... 220/270, 276; 215/256

[56] References Cited

U.S. PATENT DOCUMENTS

| | | | |
|---|---|---|---|
| 4,660,735 | 4/1987 | Peschardt et al. | 220/270 |
| 4,682,706 | 7/1987 | DeVore et al. | 220/270 |
| 4,691,834 | 9/1987 | Bullock, III | 215/256 |
| 4,711,364 | 12/1987 | Lietica | 220/276 |

*Primary Examiner*—George T. Hall

*Attorney, Agent, or Firm*—Moore & Hansen

[57] ABSTRACT

A container and lid assembly including a container having a cylindrical side wall and top rim, and a lid having an inverted U-shaped rim and depending skirt portion which is snapped over the rim of the container wall to form a sealing closure therewith. An annular ridge projects inwardly from the inner surface of the skirt portion so as to ride over and engage under the upper bead of the container wall, thereby creating single point interference fits between the container and lid. The outer edge of a first shoulder engages a score line on the inner surface of the skirt portion defining a bi-directional tear strip. The distal end of the tear strip closely confronts a second shoulder when the container is originally sealed. The inside wall of the lid prevents the container from being deformed or collapsing when opened.

26 Claims, 1 Drawing Sheet

CONTAINER AND LID WITH TAMPER EVIDENT CLOSURE

BACKGROUND OF THE INVENTION

This invention relates generally to containers and lids having tamper evident and tamper resistant closures and seals, and particularly to a resealable container closure for use with cylindrical plastic containers of the type in which perishable commodities are packaged.

Plastic containers, pails, tubs, and buckets having various resealable lids with tamper evident or tamper resistant closures are well known to the art. These pails and containers are generally filled with a particular foodstuff or other commodity by an automated container filling machine, and are then sealed and distributed to stores for purchase by the end user. The lid closures are designed such that the containers may not be opened or the contents accessed without revealing visible signs that the seals have been broken. In addition, the closures may include features or elements which make opening the closures or compromising the seals more difficult. Many of the containers and pails may be repeatedly resealed and reused by the purchaser for other applications, although the resealable closures are generally neither tamper evident or tamper resistant, nor provide air tight or moisture proof seals of the degree obtained by the initial sealing processes.

These larger containers, pails, tubs, and buckets may be distinguished from other receptacles, bottles, or jars which include tamper evident closures. The subject containers, pails, tubs, and buckets generally have thin, highly flexible side walls with lids which are snapped on or form a pressure fit. The side walls of the latter bottles and jars are generally rigid with narrow necks, and utilize caps which must be threaded or otherwise rotated onto the neck, or which contain one of several directional locking mechanisms.

One development common to several tamper evident closures is an annular skirt portion which depends from the lower peripheral edge of the lid, and which defines a weakened score line forming a tear strip along the bottom of the skirt. The tear strip will generally have an undercut region which engages an annular ridge which projects radially outward from the outer surface of the container wall, or be positioned such that the distal edge of the skirt is adjacent to or in close confronting contact with a similarly projecting shoulder, and which is torn free from the lid by the user when the original seal is broken.

U.S. Pat. No. 3,510,021 discloses a tear strip and gripping tab configuration in combination with a rigid side wall container having a narrow neck and a cooperating lug and recess arrangement which forms a twist-lock feature, and wherein the score line forming the tear strip is positioned on the outside of the skirt above the upper or most closely adjacent projecting rib. The lid is of the single wall configuration, and the outer side wall of the container presents two ribs. Such a container construction is distinct from the larger pails, buckets, and tubs in which the top or skirt portion of the lid forms a "snap-on" or interference fit seal with a corresponding bead on the container wall.

U.S. Pat. No. 3,672,528 similarly discloses a wide mouth jar and closure in which the score line forming the tear strip is positioned on the outer surface of the skirt above the nearest rib, and wherein the lower distal edge of the skirt is exposed rather than being positioned adjacent to or closely confronting a shoulder. The '528 patent again shows a two rib configuration. However, the lid presents a double wall construction which forms a pressure or friction fit seal with the top rim of the container.

U.S. Pat. No. 3,753,511 discloses a container with a push-in cover having a double walled lid which forms a pressure or compression fit seal with the container rim, and which further defines a bulged portion which increases the clamping force on the container rim which enhances the original seal and the ability to tightly reseal the container. The '511 patent positions the score line defining the tear strip on the outer surface of the skirt, and employs a single rib with no shoulder below the distal edge of the skirt.

U.S. Pat. No. 3,979,003 discloses a container and cover in which the distal end of the skirt portion is closely confronting a shoulder which projects radially outward beyond the outer surface of the skirt, and in which the score line defining the tear strip is positioned along the inner surface of the skirt portion. The '003 patent utilizes a single shoulder, and a single wall cover which is stretched to fit over and engage the top surface of the rim and outer and lower surfaces of a bead on the rim, thereby forming a compression fit which clamps the bead from several directions and creating an entire region of interference fit extending around the surface of the bead.

U.S. Pat. No. 4,037,748 discloses a container and snap-on closure, but wherein the double wall construction of the lid forms three distinct zones of interference fit against both the inner and outer surfaces of the container rim. The '748 patent positions the score line defining the tear strip along the inner surface of the skirt portion, and places the distal end of the skirt closely confronting a shoulder. The '748 patent also discloses an inwardly facing ridge on the inner surface of the skirt portion which rides over and under a sidewall ridge on the outer surface of the container wall when the lid is mounted on the container rim, and which separates the score line from the sidewall ridge.

U.S. Pat. No. 4,667,838 discloses a threaded cap for a rigid walled, narrow mouth bottle with a variation on the traditional double wall lid configuration. The closure shown in the '838 patent has three sealing projections on the outer surface of the container wall, the lowest being a very wide band having a flat outer surface which underlies the skirt portion adjacent to the score line defining the tear strip, and extending a significant distance above and below the score line. In this case, the tear strip is attached to the skirt portion by a plurality of separate connectors, and the skirt portion defines a ring which is permanently engaged under the band such that unthreading the cap from the rim will break the connectors and remove the tear strip from the skirt portion.

U.S. Pat. No. 4,669,623 discloses a single wall cap and narrow necked bottle having threads forming four outward projecting ridges on the container wall, and wherein a score line defining the tear strip is positioned on the outer surface of the skirt portion and adjacent to the third projecting ridge. The tear strip is thus locked between the third and fourth projections, and is torn from the skirt portion when the cap is unthreaded from the rim.

While the above referenced patents disclose a wide variety of containers and lids, each of which combines several different features to form distinct closure structures, these structures do present several recurring problems and defects.

Several of the closure structures are suitable for containers having rigid walls, narrow necks, threaded caps, or for use where a compression or pressure fit seal is desired. However, in many larger containers made of highly flexible thin walled plastic, such as ice cream pails or margarine tubs, these closures would not be suitable or effective.

Of those commodity containers having snap-on lids and tear strips, the tear strip and protective shoulder are generally treated as features which are separate and distinct from, and are therefore not interrelated with, the sealing and closure structure. Consequently, each feature is not utilized to its greatest potential, the sealing structure not cooperating with or enhancing the tamper evidencing features, and the tamper resistance features similarly not cooperating with the sealing features.

BRIEF SUMMARY OF THE INVENTION

It is therefore an object of this invention to design a container and lid assembly having a tamper evident closure in which the tamper evidencing features cooperate with and enhance the performance of the sealing structure.

It is a related object of this invention to design the above container and lid assembly wherein the sealing structure similarly cooperates with and enhances the performance of the tamper evidencing features.

It is another object of this invention to design the above container and closure assembly such that it forms an improved resealable closure, wherein said cooperation between the tamper evidencing and sealing means additionally serves to augment the resealable closure.

It is a further object of this invention to design the above container and lid assembly such that these advantages are incorporated into a snap-on closure presenting single point interference fits between container and lid.

It is a related object of this invention to design the above container and lid assembly such that the single point interference fit closure provides a greater seal against contaminants and a superior barrier to access against tampering.

It is an additional object of this invention to design the above container and lid assembly such that the double wall construction of the lid limits the pliability of the container wall during removal of the lid.

It is yet another object of this invention to design the above container and lid assembly such that the containers are nestable and may be easily removed from a stack or column by an automated filling and container handling mechanism.

It is a distinct object of this invention to design the above container and lid assembly such that the lids will assist in stacking the containers when displayed for purchase.

It is a related object of this invention to design the above container and lid assembly such that the lids alone may be stacked or nested and easily removed from a stack or column by an automated filling and container handling mechanism.

Briefly described, the container of this invention includes a bottom, and a generally cylindrical side wall which tapers outwardly toward a circular rim extending around the top periphery of the container wall. A lid having an inverted U-shaped rim and depending skirt portion is snapped over the rim of the container wall to form a sealing closure therewith.

The container wall defines an upper bead and pair of shoulders which project outwardly from the outer surface of the side wall. An annular ridge projects inwardly from the inner surface of the skirt portion so as to ride over and engage under the upper bead of the container wall when the lid is mounted on the container rim, thereby creating single point interference fits between the container and lid.

The outer edge of the first shoulder engages a score line on the inner surface of the skirt portion which defines a bi-directional tear strip, the first shoulder closely confronting the bottom edge of the skirt when the tear strip is removed and the container resealed, that first shoulder also defining a plurality of notches forming finger relief areas which allow the lid to be removed from the rim during reuse.

The bottom or distal end of the tear strip closely confronts the second shoulder when the container is originally sealed. This second shoulder extends radially outward beyond the outer surface of the skirt portion, thereby increasing the difficulty in tampering with the container, and providing the seal with greater integrity against contaminants. The shoulder also serves to permit several like containers to be nested in an automated filling machine, each container being easily separated from the underlying containers.

The lids may similarly be stacked in a column, and include a vent ridge configuration which allows easy separation of the lids from the column, as well as a circumferential rim to aid in stacking the filled and sealed containers for display. The inside wall of the lid prevents the container from being deformed or collapsing when opened, and further resists attempts to open the container without removing the tear strip.

DESCRIPTION OF THE PREFERRED EMBODIMENT

The container and lid assembly with a tamper evident closure of this invention is shown in FIGS. 1–8 and referenced generally therein by the numeral 10.

Figure 1:
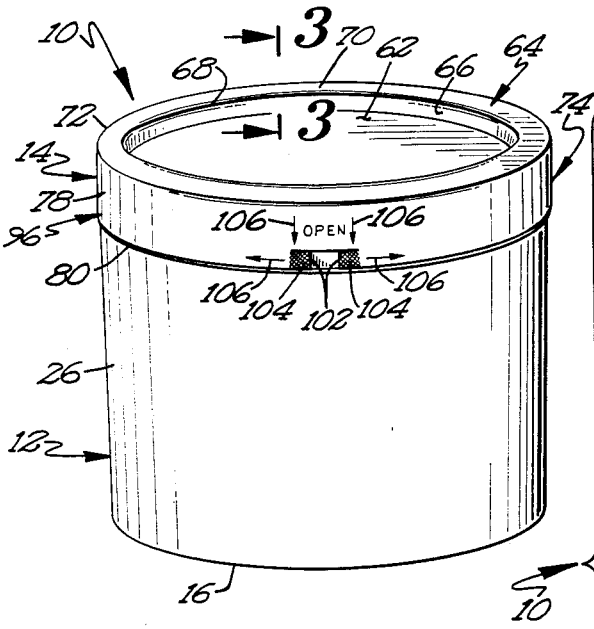
FIG. 1 is a perspective view of the container and lid with tamper evident closure of this invention.

Referring to FIG. 1, it may be seen that the container and lid assembly 10 is comprised of a separate container body 12 and a lid member 14.

The container body 12 has a generally circular bottom portion 16, with a substantially upright, outwardly tapering cylindrical side wall 18 connected to and extending upwardly from the periphery of the bottom portion 16 to define a generally circular open top 20. The container body 12 is integrally molded from any flexible plastic resin suitable for use with the particular commodity to be sealed within the container assembly 10.

The side wall 18 of the container body 12 defines a container rim region 22 adjacent to the top edge 24 of the side wall 18 and extending peripherally around the open top 20 of the container body 12.

Figure 5:
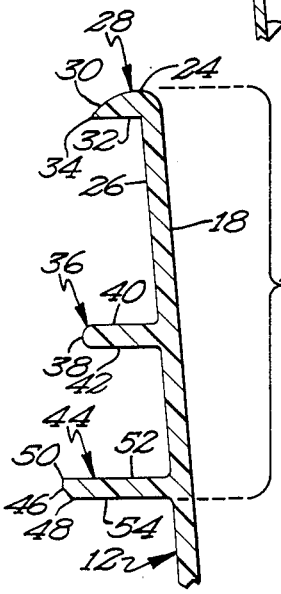
FIG. 5 is a cross sectional view of the top edge of the container body taken through line 5—5 of FIG. 2.

Referring to FIG. 5, the container rim region 22 may be seen in greater detail. Extending radially outward from the outer surface 26 of the side wall 18 of the container body 12 and adjacent to the top edge 24 of the side wall 18 is a locking bead 28 which extends completely around the top edge 24 of the container body 12. The locking bead 28 has a convexly curved or arcuate top surface 30 which extends from and is generally continuous with the radiused curvature of the top edge 24 of the side wall 18. The arcuate top surface 30 of the locking bead 28 intersects a generally horizontal, planar bottom surface 32 of the bead 28 to thereby define a sharp corner 34 along the radially outermost edge of the bead 28.

Below the locking bead 28 and spaced apart therefrom is a first shoulder 36 similarly extending radially outward from the outer surface 26 of the side wall 18 of the container body 12. The first shoulder 36 extends outwardly a distance slightly greater than the distance between the outer surface 26 of the side wall 18 of the container body 12 and the sharp corner 34 of the locking bead 28, and terminates in a fully radiused outer edge surface 38. Both the top surface 40 and the bottom surface 42 of the first shoulder 36 may be planar and oriented generally horizontally.

Further below the locking bead 28 and first shoulder 36 and spaced apart therefrom is a second shoulder 44 which extends radially outward from outer surface 26 of the side wall 18 of the container body 12. The second shoulder 44 extends outwardly a distance greater than that of the locking bead 28 and first shoulder 36, and terminates in a partially radiused outer edge 46, the outer edge 46 of the second shoulder defining a curved bottom corner 48 and a sharp top corner 50. The top surface 52 and the bottom surface 54 of the second shoulder 44 may be planar and oriented generally horizontally.

Figure 2:
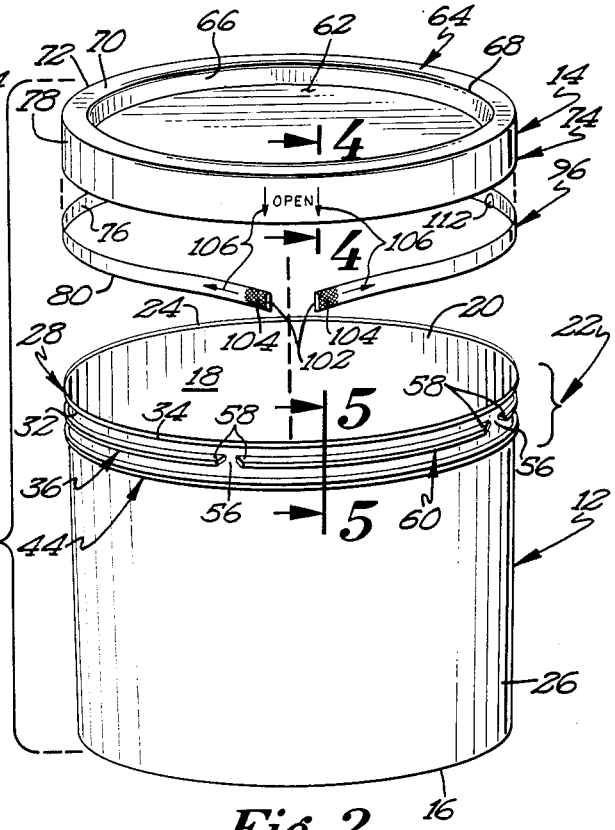
FIG. 2 is an exploded perspective view of the container body and lid member of FIG. 1 showing the tear strip removed from the lid member and the lid member removed from the container body.

Both the first shoulder 36 and the second shoulder 44 extend completely around the container rim region 22 encircling the open top 20 of the container body 12, although the first shoulder 36 may define a plurality of notches 56 as shown in FIG. 2. These notches 56 form finger relief areas, the function of which being described in detail below. Each notch 56 has a pair of opposing beveled edges 58 which extend inwardly from the outer edge 38 of the first shoulder 36 the depth of the notch 56, which may be any suitable distance but is preferably the width of the first shoulder 36 between the outer edge 38 and the outer surface 26 of the side wall 18 of the container body 12. The notches 56 are generally evenly spaced apart around the periphery of the rim region 22.

Figure 3:
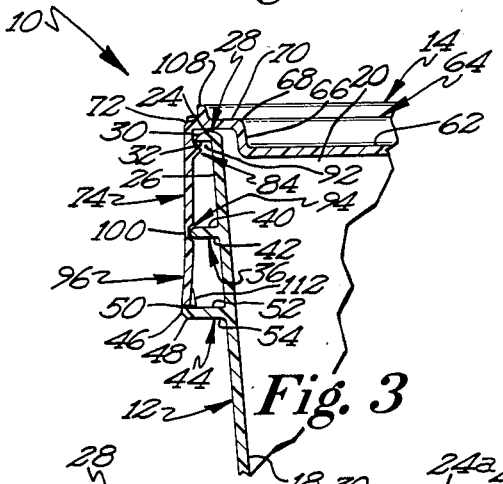
FIG. 3 is a cross sectional view of the lid member mounted on the top of the container wall taken through line 3—3 in FIG. 1.
Figure 4:
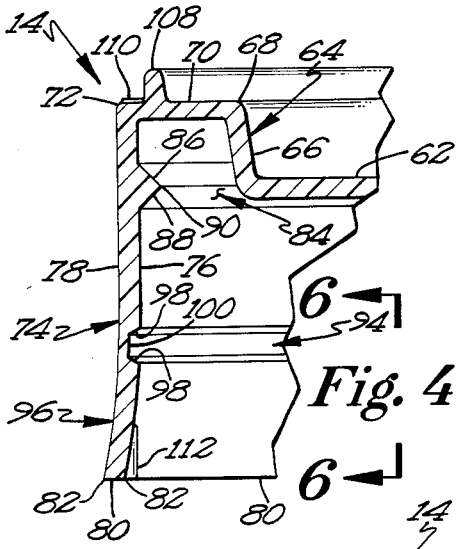
FIG. 4 is a cross sectional view of the lid member taken through line 4—4 of FIG. 2.

Referring to FIGS. 3 and 4, the lid member 14 may be seen to be comprised of a generally planar, circular top portion 62 which extends substantially over the open top 20 of the container body 12 when the lid member 14 is mounted on the container rim region 22. As shown in FIG. 4, connected to the generally planar top portion 62 is an inverted U-shaped lid rim 64 having a generally upright inner wall 66 having a top end 68, a horizontal planar bridge member 70 extending radially outward from the top end 68 of the inner wall 66 to an outer end 72, and a depending skirt portion 74 extending generally vertically downward from the outer end 72 of the bridge member 70. The top portion 62, inner wall 66, bridge member 70, and depending skirt portion 74 may be integrally molded from a similarly flexible and resilient plastic resin suitable for use with commodities to be placed within the container and lid assembly 10.

The depending skirt portion 74 has a generally uniform thickness measured between the inner surface 76 and outer surface 78 of the skirt portion 74, and may taper radially outward slightly as the skirt portion 74 extends towards and terminates in a distal end 80 having an opposing pair of sharp inner and outer corners 82.

Extending inwardly from the inner surface 76 of the skirt portion 74 below the bridge member 70 and spaced apart therefrom is a locking ridge 84. The locking ridge 84 has a generally planar angled or beveled upper surface 86, and a correspondingly angled or beveled planar lower surface 88, which intersect to form a sharp corner 90. The locking ridge 84 may extend continuously around the inner surface 76 of the skirt portion, or may be comprised of a plurality of separate projecting regions.

The locking ridge 84 is spaced apart from the bridge member 70 a distance such that when the lid member 14 is mounted on the container rim region 22, the locking ridge 84 of the lid member 14 is positioned below and under the locking bead 28 of the container body 12, as shown in FIG. 3, thereby forming a vertical space 92 between the locking ridge 84 and locking bead 28.

The sharp corner 34 of the locking bead 28 of the container body 12 may contact the inner surface 76 of the skirt portion 74 of the lid member 14 between the bridge member 70 and locking ridge 84 thereof to form a substantially single point interference fit between the lid member 14 and the container rim 22, with a generally outward pressure being exerted on the inner surface 76 of the depending skirt portion 74 by the sharp corner 34 of the locking bead 28. The sharp corner 90 of the locking ridge 84 may similarly contact the outer surface 26 of the side wall 18 of the container body 12 between the locking bead 28 and the first shoulder 36 to form a substantially single point interference fit between the lid member 14 and the container rim 22, with a generally outward and slightly downward pressure being exerted on the locking ridge 84 by the outer surface 26 of the tapered side wall 18. Although it has proven desirable to maintain a single point interference fit between the locking bead 28 and inner surface 76 of the skirt portion 74, either or both of these substantially single point interference fits may be utilized to form a sealing engagement between the container body 12 and lid member 14 when the lid member 14 is mounted on the container rim 22.

The depending skirt portion 74 also defines a weakened score line or groove 94 extending around the inner surface 76 thereof below the locking ridge 84, the groove 94 further defining a tear strip 96 extending between the groove 94 and distal end 80 of the skirt portion 74. The groove 94 is comprised of a pair of opposing beveled edges 98 connected by a thin skirt wall segment 100. The thin skirt wall segment 100 should have a thickness sufficient to securely fasten the tear strip 96 to the lid member 14, yet sufficiently thin given the particular plastic material from which the lid member 14 is formed such that the tear strip 96 may be manually separated from the lid member by tearing the skirt portion 74 along the groove 94.

The groove 94 should be spaced apart from the bridge member 70, and the beveled edges 98 of the groove 94 should be spaced apart from one another, such that at least a portion of the radiused outer edge 38 of the first shoulder 36 may be received within and engaged by the groove 94 when the lid member 14 is mounted on the container rim 22 as shown in FIG. 3. The length of the tear strip 96 measured between the groove 94 and the distal end 80 should be such that the distal end 80 of the skirt portion 74 closely confronts the top surface 52 of the second shoulder 44, with the outer edge 46 of the second shoulder 44 extending radially outward beyond the outer surface 78 of the skirt portion 74, when the lid member 14 is mounted on the container rim 22.

Referring to FIG. 2, it may be seen that the tear strip 96 extends peripherally around the lid member 14 and terminates in a pair of opposing ends 102, each of the opposing ends 102 having a serrated or scored gripping region 104 separated from the overlying skirt portion 74 by a progressive thinning of the wall segment 100 of the skirt portion 74 and the groove 94. Each gripping portion 104 may include an engraved indicator 106, such as letters or arrows designating the direction in which the end 102 of the tear strip 96 should be torn in order to remove the tear strip 96 from the remaining region of the skirt portion 74.

The notches 56 in the first shoulder 36 serve as finger relief areas at which a person may grip or contact the beveled edge 98 along the underside of the remainder of the skirt portion 74 adjacent the groove 94 once the tear strip 96 has been removed from the skirt portion 94, and thereby lift the lid member 14 from the container rim 22.

An annular retaining rim 108 projects upwardly from the top surface of the bridge member 70, and serves to retain several like lid members 14 in a vertical column when stacked one on top of another, such that the distal end 80 of each skirt portion 74 contacts and rests upon the top surface of the bridge member 70 of the lid member 14 outside the retaining rim 108. While the several lid members 14 may be stacked as described with the distal ends 80 of each skirt portion 74 contacting the top surface of the bridge member 70 of the lid member 14 below, it has proven more advantageous to include a plurality of shallow, semi-circular vent ridges 110 extending upwardly from the bridge member 70 outside the retaining rim 108, or a plurality of inwardly projecting arcuate protrusions 112 spaced apart along the inner surface of the tear strip 96 of the skirt portion 74 adjacent the distal end 80 thereof, to minimize the vacuum created between the stacked lid members 14, as disclosed in U.S. Pat. No. 4,364,476 and shown in FIGS. 4, 6 and 7.

In operation, the container body 12 is transported from a container delivery station to be filled with a particular commodity at a filling station, and is then transported to a capping and sealing station whereat a lid member 14 is removed from a stack or column of similar lid members 14, and mounted upon the respective filled container body 12.

In order to mount the lid member 14 on the container body 12, the lid member 14 is placed over the open top 20 of the container body 12 with the inverted U-shaped rim 64 aligned with the top edge 24 of the container rim 22. The lid member 14 is then pressed downward onto the container rim 22 with the skirt portion 74 being positioned on the outside or exterior of the side wall 18 of the container body 12 and encircling the locking bead 28.

The lid member 14 continues to be pressed downward until the locking ridge 84 rides completely over and engages under the locking bead 28, the locking ridge 84 snaps under the locking bead 28, and the groove 94 engages the outer edge 38 of the first shoulder 36, and such that the distal end 80 of the skirt portion 74 closely confronts or contacts the top surface 52 of the second shoulder 44.

The lid member 14 thereby forms a sealed closure covering the open top 20 of the container body 12.

In order to open this sealed closure, an individual grasps one or both of the gripping regions 104 between thumb and finger, or with a gripping tool, pulling the gripping regions 104 outward and downward to tear or rip the entire tear strip 96 away from the remainder of the skirt portion 74, thus exposing the upper surface 52 of the second shoulder 44 and the region of the outer surface 26 of the side wall 18 between the first shoulder 36 and the second shoulder 44. The person then grasps or contacts the exposed edge of the skirt portion 74 from which the tear strip 96 has been removed adjacent one of the notches 56 with one or more fingers or a prying instrument, and lifts upwardly on the skirt portion 74 to remove the lid member 14 from the container rim 22. In so doing, the locking ridge 84 again rides over the locking bead 28 in the reverse direction and disengages therefrom, the lid member 14 then being removed from the container body 12.

To reseal the closure, the lid member 14 is again placed over the open top 20 of the container body 12 with the inverted U-shaped rim 64 aligned with the top edge 24 of the container rim 22, such that the remaining skirt portion 74 encircles the locking bead 28. The lid member 14 is then pressed downward onto the container rim 22 until the locking ridge 84 rides completely over and engages under the locking bead 28, with the locking ridge 84 again snapping under the locking bead 28 and the upper beveled edge 98 of the groove 94 contacts or closely confronts the outer edge 38 of the first shoulder 36.

Figure 8:
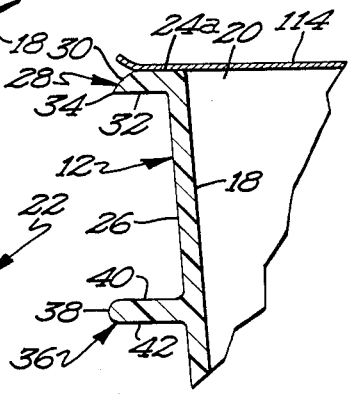
FIG. 8 is a cross sectional view of an alternate embodiment of the top edge of the container body showing a foil sealing element.
Figure 7:
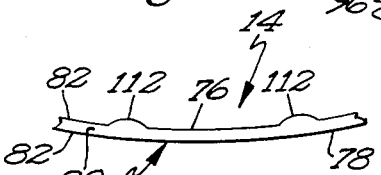
FIG. 7 is a partial segment view of the bottom edge of the tear strip taken from line 7—7 in FIG. 6.
Figure 6:
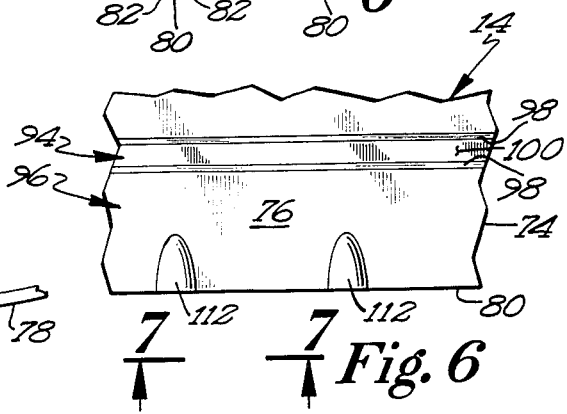
FIG. 6 is a partial view of the inner surface of the tear strip taken from line 6—6 in FIG. 4.

In one alternate embodiment shown in FIG. 8, the top edge 24a of the container wall 18 may be beveled or flattened so as to permit a foil sealing element 114 to be attached to the top edge 24a of the container wall 18 with an adhesive, the foil sealing element 114 being peeled or torn off when a person breaks the closure and seal.

While the preferred embodiment of the present invention has been described in detail with reference to the accompanying drawing figures, it is understood that various modifications and changes may be made in the container and lid assembly of this invention without departing from the spirit and scope of the appended claims.

What is claimed is:

1. A container and lid assembly comprising:

a container body, said container body including a bottom portion, a container wall having an inner surface and an outer surface extending upwardly from said bottom portion to a top edge defining an open top, a container rim extending peripherally around said open top, a locking bead extending radially outward from said outer surface of said container wall adjacent said top edge of said container wall, a first shoulder extending radially outward from said outer surface of said container wall below said locking bead and terminating in an outer edge, and a second shoulder extending radially outward from said container wall and having a top surface; and a lid member forming a sealing closure over the open top of the container body when said lid member is mounted on the container rim, said lid member comprising a top portion, a generally vertical inner wall connected to said top portion, and a skirt portion connected to and depending from said top portion and defining an inner surface, said skirt portion being positioned confronting the outer surface of the container wall and said inner wall of the lid member confronting the inner surface of the container wall when said lid member is mounted on the container rim, said skirt portion defining a ridge member extending radially inwardly from said inner surface of said skirt portion and positioned below the locking bead of the container body when said lid member is mounted on the container rim, said skirt portion further having a groove extending around said inner surface of said skirt portion below said ridge member and defining a tear strip region below said groove, said groove engaging the outer edge of the first shoulder when said lid member is mounted on the container rim, said tear strip further defining a gripping region and a distal end, said distal end closely confronting the top surface of the second shoulder when the lid member is mounted on the container rim.

2. The container and lid assembly of claim 1 wherein the locking bead of the container body contacts and forms a single point interference fit with the inner surface of the skirt portion.

3. The container and lid assembly of claim 1 wherein the locking bead of the container body has an upper surface and a lower surface, said upper surface and said lower surface intersecting to form a sharp corner.

4. The container and lid assembly of claim 1 wherein the ridge member on the inner surface of the skirt portion has an upper surface and a lower surface.

5. The container and lid assembly of claim 4 wherein the upper surface and lower surface of the ridge member are generally planar.

6. A container and lid assembly comprising:

a container body, said container body including a bottom portion, a container wall having an outer surface extending upwardly from said bottom portion of a top edge defining an open top, a locking bead extending radially outward from said outer surface of said container wall, a first shoulder extending radially outwardly from said outer surface of said container wall below said locking bead and terminating in an outer edge; and a lid member forming a sealing closure over the open top of the container body when said lid member is mounted on the container body, said lid member comprising a top portion and a skirt portion connected to and depending from said top portion and defining an inner surface, said skirt portion being positioned confronting the outer surface of the container wall when said lid member is mounted on the container body, said skirt portion defining a ridge member extending radially inwardly from said inner surface of said skirt portion and positioned below the locking bead of the container body when said lid member is mounted on the container body, said skirt portion further having a groove extending around said inner surface of said skirt portion below said ridge member and defining a tear strip region below said groove, said groove engaging the outer edge of said shoulder when said lid member is mounted on the container body.

7. The container and lid assembly of claim 1 wherein the locking bead of the container body contacts and forms a single point interference fit with the inner surface of the skirt portion.

8. The container and lid assembly of claim 1 wherein the locking bead of the container body has an upper surface and a lower surface, said upper surface and said lower surface intersecting to form a sharp corner.

9. The container and lid assembly of claim 8 wherein the upper surface of the locking bead is generally curved, and the lower surface of the locking bead is generally planar.

10. The container and lid assembly of claim 9 wherein the curve of the upper surface of the locking bead is convex.

11. The container and lid assembly of claim 8 wherein the sharp corner defines an outer peripheral edge of the locking bead.

12. The container and lid assembly of claim 1 wherein the second shoulder extends radially outward beyond the outer edge of the first shoulder.

13. The container and lid assembly of claim 1 wherein the skirt portion has an outer surface and the second shoulder extends radially outward beyond said outer surface of the skirt portion.

14. The container and lid assembly of claim 1 wherein the ridge member on the inner surface of the skirt portion has an upper surface and a lower surface.

15. The container and lid assembly of claim 14 wherein the upper surface and lower surface of the ridge member are generally planar.

16. The container and lid assembly of claim 14 wherein the upper surface and lower surface of the ridge member intersect to form a generally sharp corner.

17. The container and lid assembly of claim 1 wherein a person may unmount the lid member from the container body by lifting the lid member from the container body, and further wherein the first shoulder defines a plurality of notches forming finger relief areas in which the fingers of the person may be received when lifting the lid member to remove the lid member from the container subsequent to the tear strip being removed from the skirt portion.

18. The container and lid assembly of claim 1 wherein the tear strip defines a pair of opposing ends and a space therebetween.

19. The container and lid assembly of claim 18 wherein the opposing ends of the tear strip each define a gripping region.

20. The container and lid assembly of claim 1 wherein the lid member further comprises a rim, said rim having an inverted U-shape with first and a second opposing leg members and a bridge member connecting said first and said second opposing leg members.

21. The container and lid assembly of claim 20 wherein the first leg member includes the inner wall of the lid member, and wherein the second leg member includes the skirt portion of the lid member.

22. The container and lid assembly of claim 20 further comprising:

an annular retaining rim extending upwardly from the bridge member, said retaining rim having an inner diameter generally greater than the diameter of the container wall adjacent the bottom portion of the container body.

23. The container and lid assembly of claim 1 further comprising:

a plurality of generally arcuate protrusions extending radially inwardly from and spaced apart along the inner surface of the skirt portion adjacent the distal end of the tear strip.

24. A container and lid assembly comprising:

a container body, said container body including a bottom portion, a container wall having an outer surface extending upwardly from said bottom portion to a top edge defining an open top, and a shoulder extending radially outwardly from said outer surface of said container wall and terminating in an outer edge; and a lid member forming a sealing closure over the open top of the container body when said lid member is mounted on the container body, said lid member comprising a top portion and a skirt portion connected to and depending from said top portion and defining an inner surface, said skirt portion being positioned confronting the outer surface of the container wall when said lid member is mounted on the container body, said skirt portion having a groove extending around said inner surface of said skirt portion defining a tear strip region below said groove, said groove engaging the outer edge of the shoulder of the container body when said lid member is mounted on the container body.

25. The container and lid assembly of claim 24 wherein the sealing closure comprises one or more single point interference fits between the container body and the lid member.

26. The container and lid assembly of claim 24 wherein the container body defines a locking bead extending from the outer wall of the container body, said locking bead having a generally curved upper surface and defining a generally sharp corner contacting the inner surface of the skirt portion when the lid member is mounted on the container body.

* * * * *